US010253280B2

(12) United States Patent
Backer et al.

(10) Patent No.: US 10,253,280 B2
(45) **Date of Patent: *Apr. 9, 2019**

(54) ADDITIVE FOR REDUCING SPOTTING IN AUTOMATIC DISHWASHING SYSTEMS

(71) Applicants: Rohm and Haas Company, Philadelphia, PA (US); Union Carbide Chemicals & Plastics Technology LLC, Midland, MI (US)

(72) Inventors: Scott Backer, Phoenixville, PA (US); Severine Ferrieux, Grasse (FR); Paul Mercando, Pennsburg, PA (US); Eric P. Wasserman, Hopewell, NJ (US)

(73) Assignees: Rohn and Haas Company, Philadelphia, PA (US); Union Carbide Chemical & Plastics Technology LLC, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/515,716

(22) PCT Filed: Oct. 5, 2015

(86) PCT No.: PCT/US2015/053990

§ 371 (c)(1),
(2) Date: Mar. 30, 2017

(87) PCT Pub. No.: WO2016/057391

PCT Pub. Date: Apr. 14, 2016

(65) Prior Publication Data

US 2017/0298299 A1 Oct. 19, 2017

(30) Foreign Application Priority Data

Oct. 9, 2014 (EP) ..... 14290305

(51) Int. Cl.

| | |
|---|---|
| ***C11D 3/10*** | (2006.01) |
| ***C11D 3/37*** | (2006.01) |
| ***C11D 3/39*** | (2006.01) |
| ***C11D 3/395*** | (2006.01) |
| ***C11D 3/20*** | (2006.01) |

(52) U.S. Cl.
CPC ..... *C11D 3/378* (2013.01); *C11D 3/10* (2013.01); *C11D 3/2086* (2013.01); *C11D 3/3917* (2013.01); *C11D 3/3942* (2013.01)

(58) Field of Classification Search
CPC ..... C11D 3/10; C11D 3/2086; C11D 3/378; C11D 3/39; C11D 3/395
See application file for complete search history.

(56) References Cited

U.S. PATENT DOCUMENTS

| | | | | |
|---|---|---|---|---|
| 8,101,027 | B2 | 1/2012 | Vandermeulen et al. | |
| 2010/0167975 | A1* | 7/2010 | Vandermeulen | C11D 1/66 510/230 |
| 2010/0234264 | A1* | 9/2010 | Creamer | C11D 3/08 510/229 |
| 2010/0294309 | A1 | 11/2010 | Tropsch | |
| 2011/0226288 | A1 | 9/2011 | Warkotsch et al. | |
| 2013/0055508 | A1 | 3/2013 | Miralles et al. | |

FOREIGN PATENT DOCUMENTS

| | | | |
|---|---|---|---|
| EP | 2657329 | A1 | 10/2013 |
| WO | 2016/057602 | A1 | 4/2016 |

* cited by examiner

*Primary Examiner* — Brian P Mruk

(57) ABSTRACT

A phosphorus-free automatic dishwashing detergent composition comprising: (a) 0.5 to 10 wt % of a polymer comprising polymerized units of: (i) 65 to 75 wt % (meth) acrylic acid, (ii) 15 to 25 wt % of a monoethylenically unsaturated dicarboxylic acid and (iii) 7 to 13 wt % 2-acrylamido-2-methylpropanesulfonic acid (AMPS); and having $M_w$ from 5,000 to 100,000; (b) 15 to 50 wt % carbonate, (c) 0 to 50 wt % citrate and (d) 10 to 40 wt % of a bleaching agent.

4 Claims, No Drawings

ADDITIVE FOR REDUCING SPOTTING IN AUTOMATIC DISHWASHING SYSTEMS

BACKGROUND

This invention relates generally to a detergent composition that reduces spotting in non-phosphate automatic dishwashing systems.

Automatic dishwashing detergents are generally recognized as a class of detergent compositions distinct from those used for fabric washing or water treatment. Automatic dishwashing detergents are required to produce a spotless and film-free appearance on washed items after a complete cleaning cycle. Phosphate-free compositions rely on non-phosphate builders, such as salts of citrate, carbonate, silicate, disilicate, bicarbonate, aminocarboxylates and others to sequester calcium and magnesium from hard water, and upon drying, leave an insoluble visible deposit. Polymers made from acrylic acid, maleic acid and 2-acrylamido-2-methylpropanesulfonic acid (AMPS) are known for use in inhibiting the scale produced from non-phosphate builders. For example, U.S. Pub. No. 2010/0234264 discloses a polymer made from acrylic acid, maleic acid and AMPS in a detergent composition. However, this reference does not disclose the compositions of the present invention, which offer improved performance.

STATEMENT OF INVENTION

The present invention is directed to a phosphorus-free automatic dishwashing detergent composition comprising: (a) 0.5 to 10 wt % of a polymer comprising polymerized units of: (i) 65 to 75 wt % (meth)acrylic acid, (ii) 15 to 25 wt % of a monoethylenically unsaturated dicarboxylic acid and (iii) 7 to 13 wt % 2-acrylamido-2-methylpropanesulfonic acid (AMPS); and having $M_w$ from 5,000 to 100,000; (b) 15 to 50 wt % carbonate, (c) 0 to 50 wt % citrate and (d) 10 to 40 wt % of a bleaching agent.

DETAILED DESCRIPTION

All percentages are weight percentages (wt %), and all temperatures are in ° C., unless otherwise indicated. Weight average molecular weights, $M_w$, are measured by gel permeation chromatography (GPC) using polyacrylic acid standards, as is known in the art. The techniques of GPC are discussed in detail in Modern Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. The molecular weights reported herein are in units of daltons. As used herein the term "(meth)acrylic" refers to acrylic or methacrylic; the term "carbonate" to alkali metal or ammonium salts of carbonate, bicarbonate, percarbonate, sesquicarbonate; the term "silicate" to alkali metal or ammonium salts of silicate, disilicate, metasilicate; and the term "citrate" to alkali metal citrates. Preferably, the carbonates, silicates or citrates are sodium, potassium or lithium salts; preferably sodium or potassium; preferably sodium. Weight percentages of carbonates or citrates are based on the actual weights of the salts, including metal ions. The term "phosphorus-free" refers to compositions containing less than 0.5 wt % phosphorus (as elemental phosphorus), preferably less than 0.2 wt %, preferably less than 0.1 wt %, preferably no detectable phosphorus. Weight percentages in the detergent composition are percentages of dry weight, i.e., excluding any water that may be present in the detergent composition.

Percentages of monomer units in the polymer are percentages of solids weight, i.e., excluding any water present in a polymer emulsion.

Preferably, the amount of citrate in the detergent composition is at least 10 wt %, preferably at least 15 wt %, preferably at least 20 wt %; preferably no more than 45 wt %, preferably no more than 40 wt %, preferably no more than 35 wt %. Preferably, the amount of carbonate is at least 20 wt %, preferably at least 22 wt %; preferably no more than 45 wt %, preferably no more than 40 wt %, preferably no more than 35 wt %, preferably no more than 30 wt %. Preferably, the bleaching agent is percarbonate or perborate. Preferably, the amount of bleaching agent is at least 11 wt %, preferably at least 12 wt %, preferably at least 13 wt %; preferably no more than 35 wt %, preferably no more than 30 wt %, preferably no more than 25 wt %, preferably no more than 22 wt %, preferably no more than 20 wt %, preferably no more than 18 wt %.

Preferably, the detergent composition comprises an aminocarboxylate builder, preferably in an amount from 1 to 35 wt %; preferably at least 1.5 wt %, preferably at least 2 wt %, preferably at least 5 wt %, preferably at least 10 wt %; preferably no more than 30 wt %, preferably no more than 25 wt %, preferably no more than 20 wt %. A preferred aminocarboxylate builder is methylglycinediacetic acid (MGDA).

Preferably, the polymer comprises at least 67 wt % polymerized units of (meth)acrylic acid, preferably at least 68 wt %, preferably at least 69 wt %; preferably no more than 73 wt %, preferably no more than 72 wt %, preferably no more than 71 wt %. Preferably, the monoethylenically unsaturated dicarboxylic acid units are at least 17 wt % of the polymer, preferably at least 18 wt %, preferably at least 19 wt %; preferably no more than 23%, preferably no more than 22 wt %, preferably no more than 21 wt %. In cases where the monoethylenically unsaturated dicarboxylic acid is available in the form of an anhydride, the polymer is made by polymerizing the anhydride, which is hydrolyzed to the acid during the polymerization process, resulting in a polymerized unit of a monoethylenically unsaturated dicarboxylic acid. All references to polymerized dicarboxylic acid units in the polymer include metal salts of the acid which would be present at pH values near or above the pKa of the carboxylic acid groups. Preferably, the monoethylenically unsaturated dicarboxylic acid has from four to six carbon atoms, preferably four or five. Preferably, the monoethylenically unsaturated dicarboxylic acid is selected from the group consisting of maleic acid, fumaric acid, itaconic acid, mesaconic acid and citraconic acid.

Preferably, the amount of polymerized AMPS units (including metal or ammonium salts) in the polymer is at least 8 wt %, preferably at least 9 wt %; preferably no more than 12.5 wt %, preferably no more than 12 wt %, preferably no more than 11.5 wt %. Preferably, the total amount of monoethylenically unsaturated dicarboxylic acid and AMPS units in the polymer is at least 24 wt %, preferably at least 26 wt %, preferably at least 28 wt %, preferably at least 29 wt %, preferably at least 30 wt %.

Preferably, the polymer contains no more than 8 wt % polymerized units of esters of acrylic or methacrylic acid, preferably no more than 5 wt %, preferably no more than 2 wt %, preferably no more than 1 wt %.

Preferably, the polymer has $M_w$ of at least 8,000, preferably at least 9,000, preferably at least 10,000, preferably at least 11,000, preferably at least 12,000; preferably no more than 70,000, preferably no more than 50,000, preferably no more than 30,000, preferably no more than 25,000.

The polymer may be used in combination with other polymers useful for controlling insoluble deposits in automatic dishwashers, including, e.g, polymers comprising combinations of residues of acrylic acid, methacrylic acid, maleic acid or other diacid monomers, esters of acrylic or methacrylic acid including polyethylene glycol esters, styrene monomers, AMPS and other sulfonated monomers, and substituted acrylamides or methacrylamides.

The polymer of this invention may be produced by any of the known techniques for polymerization of acrylic monomers. Preferably, the initiator does not contain phosphorus. Preferably, the polymer contains less than 1 wt % phosphorus, preferably less than 0.5 wt %, preferably less than 0.1 wt %, preferably the polymer contains no phosphorus. Preferably, polymerization is initiated with persulfate and the end group on the polymer is a sulfate or sulfonate. The polymer may be in the form of a water-soluble solution polymer, slurry, dried powder, or granules or other solid forms.

Other components of the automatic dishwashing detergent composition may include, e.g., surfactants, oxygen and/or chlorine bleaches, bleach activators, enzymes, foam suppressants, colors, fragrances, antibacterial agents and fillers. Typical surfactant levels depend on the particular surfactant(s) used; preferably the total amount of surfactant is from 0.5 wt % to 15 wt %, preferably at least 0.7 wt %, preferably at least 0.9 wt %; preferably no more than 10 wt %, preferably no more than 7 wt %, preferably no more than 4 wt %, preferably no more than 2 wt %, preferably no more than 1 wt %. Preferably, the surfactant comprises a nonionic surfactant. Preferably, nonionic surfactants have the formula $RO\text{-}(M)_x\text{-}(N)_y\text{—}OH$ or $R\text{—}O\text{-}(M)_x\text{-}(N)_y\text{—}O\text{—}R'$ in which M and N are units derived from alkylene oxides (of which one is ethylene oxide), R represents a $C_6$-$C_{22}$ linear or branched alkyl group, and R' represents a group derived from the reaction of an alcohol precursor with a $C_6$-$C_{22}$ linear or branched alkyl halide, epoxyalkane, or glycidyl ether. Fillers in tablets or powders are inert, water-soluble substances, typically sodium or potassium salts, e.g., sodium or potassium sulfate and/or chloride, and typically are present in amounts ranging from 0 wt % to 75 wt %. Fillers in gel formulations may include those mentioned above and also water. Fragrances, dyes, foam suppressants, enzymes and antibacterial agents usually total no more than 5 wt % of the composition.

Preferably, the composition has a pH (at 1 wt % in water) of at least 10, preferably at least 11.5; in some embodiments the pH is no greater than 13.

The composition can be formulated in any typical form, e.g., as a tablet, powder, monodose, sachet, paste, liquid or gel. The composition can be used under typical operating conditions for any typical automatic dishwasher. Typical water temperatures during the washing process preferably are from 20° C. to 85° C., preferably from 30° C. to 70° C. Typical concentrations for the composition as a percentage of total liquid in the dishwasher preferably are from 0.1 to 1 wt %, preferably from 0.2 to 0.7 wt %. With selection of an appropriate product form and addition time, the composition may be present in the prewash, main wash, penultimate rinse, final rinse, or any combination of these cycles.

Preferably, the composition comprises at least 1 wt % of said polymer, preferably at least 1.5 wt %, preferably at least 2 wt %, preferably at least 2.5 wt %, preferably at least 3 wt %; preferably no more than 8 wt %, preferably no more than 7 wt %, preferably no more than 6 wt %.

EXAMPLES

Synthesis of Example Terpolymer:
Phosphate Free

ADW
Objective: Prepare an AA/Maleic/AMPS//70/20/10 wt % dispersant, Mw ~15K

| Kettle Charge | Grams | BOM | Procedure | |
|---|---|---|---|---|
| DiH2O | 275 | | Charge kettle and heat to 78 C. | |
| Maleic Anhydride | 69 | 20% | | |
| FeSO4 (0.15%) | 3.32 | | Add pre-charges<br>Begin cofeeds at<br>78 C. | |
| Kettle Pre-charge | | | | |
| SMBS | 2.8 | 0.70% | Add CTA over 80 mins | |
| DiH2O | 7 | | Add init over 95 mins<br>Add mono over 90 mins | |
| Monomer Cofeed | | | | |
| AA | 278 | 70% | Hold 10 mins at completition | |
| AMPS | 80 | 10% | Add over 10 mins/hold 20 mins<br>Repeat chaser and hold 20 mins | |
| Initiator Cofeed | | | | |
| NaPS | 2.92 | 0.73% | With cooling, add neut #1 | |
| DiH2O | 30 | | Scavenge with peroxide<br>Post neutralize | |
| CTA | | | | |
| SMBS | 59.2 | 14.81% | Cool and pack | |
| DiH2O | 100 | | | |
| Chaser | | | | |
| NaPS | 0.53 | 0.13% | Total Charged | 1290.1 |
| DiH2O | 15 | | Total Monomer | 400 |
| NaPS | 0.53 | | Total Solids | 534.40 |
| DiH2O | 15 | | % Solids | 41.42 |
| NaOH (50%) | 100 | | | |
| H2O2 (35%) | 1.8 | | | |
| NaOH (50%) | 150 | | | |
| DiH2O (rinse) | 100 | | | |

Observations:

| | Temp | RPM | Comments |
|---|---|---|---|
| 0' | 78 | 176 | Add SMBS kettle additive |
| 1' | 78 | | Begin cofeeds |
| 20' | 78 | | |
| 30' | 78 | | |
| 50' | 78 | | |
| 70' | 78 | | |
| 80' | 78 | | SMBS cofeed completed |
| 90' | 78 | | Monomer completed |
| 95' | 78 | | Initiator completed, hold<br>Added chaser over 10 mins, hold 20 mins<br>Repeat Chaser and hold. |
| | 60 | | Begin cooling. Add 1st neutralizer<br>Scavenge<br>Add final neutralizer, cool and pack |

Characterizations:

| | |
|---|---|
| Solids | 41.03% |
| pH | 6.85 |
| Viscosity | 600 |
| Residual AA | 0 |
| Residual Maleic | 343 |

| GPC | Mw | Mn | Mw/Mn | Mp |
|---|---|---|---|---|
| Final | 13861 | 1343 | 10.31 | 3438 |
| Acusol 445 | 6674 | 1608 | 4.14 | 4208 |

Other polymers were made using the same process.
Preparation of Food Soil:

| Ingredients | Wt., g |
|---|---|
| Water | 700.0 |
| Instant Gravy | 25.0 |
| Starch | 5.0 |
| Benzoic Acid | 1.0 |
| Margarine | 100.0 |
| Milk (3.5% Fat) | 50.0 |
| Ketchup | 25.0 |
| Mustard | 25.0 |
| Egg yolk | 3.0 |
| Total: | 934.0 |

1. Bring water to a boil.
2. Mix in 16 oz paper cup: instant gravy, benzoic acid and starch; add this mixture to the boiling water.
3. Add milk and margarine.
4. Let the mixture cool down to approximately 40° C.
5. Fill the mixture into a bowl of Kitchen Machine (Polytron).
6. In a 16 oz paper cup, mix the egg yolk, ketchup and mustard using a spoon.
7. Add the cool down mixture to the bowl stirring continuously.
8. Let the mixture stir for 5 min.
9. Freeze the mixture.
10. The frozen slush is placed into the dishwasher prior to the starting program.

Conditions for Dishwashing Tests:

Machine: Kenmore SS-ADW, Model 15693

Wash program: Normal wash cycle with heated wash, fuzzy logic engaged, heated dry Cycle time: ca. 2 h Water hardness: 300 ppm as $CaCO_3$ (confirmed by EDTA Titration)

Ca:Mg (molar): 2:1

Tank water T, ° C.: 54

ADW basin initial T, ° C.: 43

Total detergent weight, g 20

Food soil: STIWA (50 g per cycle)

Food soil charged when the detergent is charged to the wash liquor (20 min mark).

After drying in open air, two glasses were rated from 1 (clean) to 5 (heavily fouled) on both fouling and spotting by two trained observers. (See ASTM-D 3556-85.)

Abbreviations

AA acrylic acid

ADW automatic dishwasher

AMPS 2-acrylamido-2-methyl-1-propanesulfonic acid

EA ethyl acrylate

IA itaconic acid

Mal maleic acid

MGDA methylglycinediacetic acid, sodium salt

Mn number-average molecular weight

Mw weight-average molecular weight

TAED tetraacetylethylenediamine

TABLE 1

Polymers used in auto-dishwashing examples

| | Mon 1 (%) | Mon 2 (%) | Mon 3 (%) | Mw/1000 | Mw/Mn | solids, % |
|---|---|---|---|---|---|---|
| Polymer A | AA (70) | Mal (20) | AMPS (10) | 13.9 | 10.3 | 41.0 |
| Polymer B | AA (72) | AMPS (28) | — | 16.5 | 4.0 | 92.0 |

TABLE 1-continued

Polymers used in auto-dishwashing examples

| | Mon 1 (%) | Mon 2 (%) | Mon 3 (%) | Mw/1000 | Mw/Mn | solids, % |
|---|---|---|---|---|---|---|
| Polymer C | AA (90) | Mal (10) | — | 5.0 | 4.1 | 42.2 |
| Polymer D | AA (70) | IA (20) | AMPS (10) | 12.6 | 5.5 | 44.4 |
| Polymer E | AA (70) | Mal (10) | AMPS (20) | 12.4 | 6.6 | 38.6 |
| Polymer F | AA (70) | Mal (20) | AMPS (10) | 21.1 | 10.8 | 42.1 |
| Polymer G* | AA (60) | Mal (20) | AMPS (10) | 13.6 | 7.9 | 38.0 |

*The monomer mixture for Polymer G also contained 10% ethyl acrylate

TABLE 2

ADW Examples 1: Performance in Citrate-Based Formulations.

| | Comp. Ex. 1 | Ex. 1 | Comp. Ex. 2 |
|---|---|---|---|
| Sodium Citrate, % | 30 | 30 | 30 |
| Sodium Carbonate, % | 25 | 25 | 25 |
| Sodium Percarbonate, % | 15 | 15 | 15 |
| TAED, % | 4 | 4 | 4 |
| TRITON ™ DF-16, % | 0.75 | 0.75 | 0.75 |
| TERGITOL ™ L61, % | 0.25 | 0.25 | 0.25 |
| Polymer A, % | 0 | 4 | 0 |
| Polymer B, % | 4 | 0 | 3 |
| Polymer C, % | 0 | 0 | 1 |
| α-Amylase from Bacillus, % | 1 | 1 | 1 |
| Protease from Bacillus, % | 2 | 2 | 2 |
| Sodium disilicate[a], % | 2 | 2 | 2 |
| MGDA[b], % | 0 | 0 | 0 |
| Sodium Sulfate, % | 16 | 16 | 16 |
| Total Wt % | 100 | 100 | 100 |
| Filming (Obs. 1, Glass 1) | 2.0 | 1.5 | 1.5 |
| Filming (Obs. 1, Glass 2) | 2.2 | 1.5 | 1.5 |
| Filming (Obs. 2, Glass 1) | 1.9 | 2.0 | 2.2 |
| Filming (Obs. 2, Glass 2) | 1.9 | 2.1 | 2.3 |
| Average Filming Rating | 2.0 | 1.8 | 1.9 |
| Spotting (Obs. 1, Glass 1) | 3.2 | 1.2 | 4.0 |
| Spotting (Obs. 1, Glass 2) | 3.5 | 1.2 | 4.0 |
| Spotting (Obs. 2, Glass 1) | 3.5 | 1.2 | 4.5 |
| Spotting (Obs. 2, Glass 2) | 3.5 | 1.2 | 4.5 |
| Average Spotting Rating | 3.4 | 1.2 | 4.3 |

[a]BRITESIL H 20, PQ Corp.;
[b]TRILON M, BASF.

TABLE 3

ADW Examples 3: Performance in Mixed Citrate/MGDA Formulations

| | Comp. Ex. 3 | Comp. Ex. 4 | Ex. 2 |
|---|---|---|---|
| Sodium Citrate, % | 10 | 10 | 10 |
| Sodium Carbonate, % | 25 | 25 | 25 |
| Sodium Percarbonate, % | 15 | 15 | 15 |
| TAED, % | 4 | 4 | 4 |
| TRITON ™ DF-16, % | 0.75 | 0.75 | 0.75 |
| TERGITOL ™ L61, % | 0.25 | 0.25 | 0.25 |
| Polymer A, % | 0 | 0 | 4 |
| Polymer B, % | 4 | 4 | 0 |
| α-Amylase from Bacillus, % | 1 | 1 | 1 |
| Protease from Bacillus, % | 2 | 2 | 2 |
| Sodium disilicate[a], % | 2 | 2 | 2 |
| MGDA[b], % | 10 | 5 | 5 |
| Sodium Sulfate, % | 26 | 31 | 31 |
| Total Wt % | 100 | 100 | 100 |

TABLE 3-continued

ADW Examples 3: Performance in Mixed Citrate/MGDA Formulations

| | Comp. Ex. 3 | Comp. Ex. 4 | Ex. 2 |
|---|---|---|---|
| Filming (Obs. 1, Glass 1) | 1.5 | 1.5 | 3.0 |
| Filming (Obs. 1, Glass 2) | 1.5 | 1.5 | 3.0 |
| Filming (Obs. 2, Glass 1) | 1.5 | 1.9 | 2.6 |
| Filming (Obs. 2, Glass 2) | 1.7 | 1.7 | 2.6 |
| Average Filming Rating | 1.6 | 1.7 | 2.8 |
| Spotting (Obs. 1, Glass 1) | 2.2 | 2.8 | 1.2 |
| Spotting (Obs. 1, Glass 2) | 2.5 | 3.5 | 1.2 |
| Spotting (Obs. 2, Glass 1) | 3.0 | 3.3 | 1.5 |
| Spotting (Obs. 2, Glass 2) | 3.2 | 3.7 | 1.3 |
| Average Spotting Rating | 2.7 | 3.3 | 1.3 |

[a]BRITESIL H 20, PQ Corp.;
[b]TRILON M, BASF.

TABLE 4

ADW Examples 4: Performance in MGDA-Based Formulations.

| | Comp. Ex. 5 | Ex. 3 |
|---|---|---|
| Sodium Citrate, % | 0 | 0 |
| Sodium Carbonate, % | 25 | 25 |
| Sodium Percarbonate, % | 15 | 15 |
| TAED, % | 4 | 4 |
| TRITON ™ DF-16, % | 0.75 | 0.75 |
| TERGITOL ™ L61, % | 0.25 | 0.25 |
| Polymer A, % | 0 | 4 |
| Polymer B, % | 4 | 0 |
| α-Amylase from Bacillus, % | 1 | 1 |
| Protease from Bacillus, % | 2 | 2 |
| Sodium disilicate[a], % | 2 | 2 |
| MGDA[b], % | 15 | 15 |
| Sodium Sulfate, % | 31 | 31 |
| Total Wt % | 100 | 100 |
| Filming (Obs. 1, Glass 1) | 1.5 | 1.2 |
| Filming (Obs. 1, Glass 2) | 1.5 | 1.5 |
| Filming (Obs. 2, Glass 1) | 1.4 | 1.8 |
| Filming (Obs. 2, Glass 2) | 1.4 | 1.8 |
| Average Filming Rating | 1.5 | 1.6 |
| Spotting (Obs. 1, Glass 1) | 2.5 | 1.2 |
| Spotting (Obs. 1, Glass 2) | 2.8 | 1.5 |
| Spotting (Obs. 2, Glass 1) | 3.0 | 1.2 |
| Spotting (Obs. 2, Glass 2) | 3.5 | 1.4 |
| Average Spotting Rating | 3.0 | 1.3 |

[a]BRITESIL H 20, PQ Corp.;
[b]TRILON M, BASF.

TABLE 5

ADW Examples 5: Performance in Surfactant-Free Formulations.

| | Comp. Ex. 6 | Ex. 4 | Comp. Ex. 7 | Ex. 5 |
|---|---|---|---|---|
| Sodium Citrate, % | 20 | 20 | 0 | 0 |
| Sodium Carbonate, % | 25 | 25 | 25 | 25 |
| Sodium Percarbonate, % | 15 | 15 | 15 | 15 |
| TAED, % | 4 | 4 | 4 | 4 |
| TRITON ™ DF-16, % | 0 | 0 | 0 | 0 |
| TERGITOL ™ L61, % | 0 | 0 | 0 | 0 |
| Polymer A, % | 0 | 4 | 0 | 4 |
| Polymer B, % | 4 | 0 | 4 | 0 |
| α-Amylase from Bacillus, % | 1 | 1 | 1 | 1 |
| Protease from Bacillus, % | 2 | 2 | 2 | 2 |
| Sodium disilicate[a], % | 2 | 2 | 2 | 2 |
| MGDA[b], % | 0 | 0 | 15 | 15 |
| Sodium Sulfate, % | 27 | 27 | 32 | 32 |
| Total Wt % | 100 | 100 | 100 | 100 |

TABLE 5-continued

ADW Examples 5: Performance in Surfactant-Free Formulations.

| | Comp. Ex. 6 | Ex. 4 | Comp. Ex. 7 | Ex. 5 |
|---|---|---|---|---|
| Filming (Obs. 1, Glass 1) | 2.0 | 3.5 | 1.5 | 1.8 |
| Filming (Obs. 1, Glass 2) | 1.8 | 3.5 | 1.5 | 2.2 |
| Filming (Obs. 2, Glass 1) | 1.8 | 2.8 | 1.8 | 1.8 |
| Filming (Obs. 2, Glass 2) | 1.8 | 2.8 | 1.8 | 1.9 |
| Average Filming Rating | 1.9 | 3.2 | 1.7 | 1.9 |
| Spotting (Obs. 1, Glass 1) | 3.5 | 1.2 | 2.5 | 1.2 |
| Spotting (Obs. 1, Glass 2) | 3.5 | 1.2 | 2.5 | 1.5 |
| Spotting (Obs. 2, Glass 1) | 3.5 | 1.5 | 2.1 | 1.5 |
| Spotting (Obs. 2, Glass 2) | 3.2 | 1.5 | 2.3 | 1.5 |
| Average Spotting Rating | 3.4 | 1.4 | 2.4 | 1.4 |

[a]BRITESIL H 20, PQ Corp.;
[b]TRILON M, BASF.

TABLE 6

ADW Examples 6: Effect on Citrate-Based Formulations with Varying Disilicate Levels.

| | Comp. Ex. 8 | Comp. Ex. 9 | Ex. 6 | Ex. 7 |
|---|---|---|---|---|
| Sodium Citrate, % | 20 | 20 | 20 | 20 |
| Sodium Carbonate, % | 25 | 25 | 25 | 25 |
| Sodium Percarbonate, % | 15 | 15 | 15 | 15 |
| TAED, % | 4 | 4 | 4 | 4 |
| TRITON ™ DF-16, % | 0.75 | 0.75 | 0.75 | 0.75 |
| TERGITOL ™ L61, % | 0.25 | 0.25 | 0.25 | 0.25 |
| Polymer A, % | 0 | 0 | 4 | 4 |
| Polymer B, % | 4 | 4 | 0 | 0 |
| α-Amylase from Bacillus, % | 1 | 1 | 1 | 1 |
| Protease from Bacillus, % | 2 | 2 | 2 | 2 |
| Sodium disilicate[a], % | 0 | 5 | 0 | 5 |
| MGDA[b], % | 0 | 0 | 0 | 0 |
| Sodium Sulfate, % | 28 | 23 | 28 | 23 |
| Total Wt % | 100 | 100 | 100 | 100 |
| Filming Rating (Obs. 1, Glass 1) | 1.2 | 2.0 | 2.5 | 3.8 |
| Filming Rating (Obs. 1, Glass 2) | 1.2 | 1.5 | 2.5 | 3.8 |
| Filming Rating (Obs. 2, Glass 1) | 1.4 | 1.5 | 2.3 | 3.0 |
| Filming Rating (Obs. 2, Glass 2) | 1.5 | 1.6 | 2.3 | 3.2 |
| Average Filming Rating | 1.3 | 1.7 | 2.4 | 3.5 |
| Spotting Rating (Obs. 1, Glass 1) | 3.0 | 3.0 | 1.5 | 1.2 |
| Spotting Rating (Obs. 1, Glass 2) | 2.5 | 3.0 | 1.5 | 1.5 |
| Spotting Rating (Obs. 2, Glass 1) | 3.5 | 3.5 | 1.4 | 1.5 |
| Spotting Rating (Obs. 2, Glass 2) | 3.5 | 3.5 | 1.4 | 1.5 |
| Average Spotting Rating | 3.1 | 3.3 | 1.5 | 1.4 |

[a]BRITESIL H 20, PQ Corp.;
[b]TRILON M, BASF.

TABLE 7

ADW Examples 7: Variations in Polymer Composition, Mol. Wt.

| | Ex. 8 | Ex. 9 | Comp. Ex. 10 | Ex. 10 | Comp. Ex. 11 | Comp. Ex. 12 |
|---|---|---|---|---|---|---|
| Sodium Citrate, % | 30 | 30 | 30 | 30 | 30 | 30 |
| Sodium Carbonate, % | 25 | 25 | 25 | 25 | 25 | 25 |
| Sodium Percarbonate, % | 15 | 15 | 15 | 15 | 15 | 15 |
| TAED, % | 4 | 4 | 4 | 4 | 4 | 4 |
| TRITON ™ DF-16, % | 0.75 | 0.75 | 0.75 | 0.75 | 0.75 | 0.75 |
| TERGITOL ™ L61, % | 0.25 | 0.25 | 0.25 | 0.25 | 0.25 | 0.25 |
| Polymer A, % | 3 | 0 | 0 | 0 | 0 | 0 |
| Polymer B, % | 1 | 1 | 1 | 1 | 1 | 4 |
| Polymer C, % | 0 | 0 | 0 | 0 | 0 | 0 |
| Polymer D, % | 0 | 3 | 0 | 0 | 0 | 0 |
| Polymer E, % | 0 | 0 | 3 | 0 | 0 | 0 |
| Polymer F, % | 0 | 0 | 0 | 3 | 0 | 0 |
| Polymer G, % | 0 | 0 | 0 | 0 | 3 | 0 |
| α-Amylase from *Bacillus*, % | 1 | 1 | 1 | 1 | 1 | 1 |
| Protease from *Bacillus*, % | 2 | 2 | 2 | 2 | 2 | 2 |
| Sodium disilicate[a], % | 2 | 2 | 2 | 2 | 2 | 2 |
| MGDA[b], % | 0 | 0 | 0 | 0 | 0 | 0 |
| Sodium Sulfate, % | 16 | 16 | 16 | 16 | 16 | 16 |
| Total Wt % | 100 | 100 | 100 | 100 | 100 | 100 |
| Filming (Obs. 1, Glass 1) | 1.5 | 2.0 | 1.2 | 1.5 | 1.5 | 1.5 |
| Filming (Obs. 1, Glass 2) | 1.5 | 2.2 | 1.2 | 2.0 | 1.2 | 1.5 |
| Filming (Obs. 2, Glass 1) | 1.8 | 2.0 | 1.3 | 1.8 | 1.2 | 1.2 |
| Filming (Obs. 2, Glass 2) | 1.9 | 2.1 | 1.3 | 1.9 | 1.2 | 1.2 |
| Average Filming Rating | 1.7 | 2.1 | 1.3 | 1.8 | 1.3 | 1.4 |
| Spotting (Obs. 1, Glass 1) | 1.2 | 1.5 | 3.2 | 1.5 | 3.5 | 4.0 |
| Spotting (Obs. 1, Glass 2) | 1.5 | 1.5 | 3.5 | 1.5 | 3.5 | 4.0 |
| Spotting (Obs. 2, Glass 1) | 1.5 | 1.6 | 3.5 | 2.0 | 3.5 | 3.3 |
| Spotting (Obs. 2, Glass 2) | 1.6 | 1.7 | 3.5 | 2.0 | 3.5 | 3.5 |
| Average Spotting Rating | 1.5 | 1.6 | 3.4 | 1.8 | 3.5 | 3.7 |

[a]BRITESIL H 20, PQ Corp.;
[b]TRILON M, BASF.

The invention claimed is:

1. A phosphorus-free automatic dishwashing detergent composition comprising:

(a) 2 to 8 wt % of a polymer comprising polymerized units of:

(i) 69 to 71 wt % of acrylic acid, (ii) 19 to 21 wt % of maleic acid; and (iii) 9 to 11.5 wt % of 2-acrylamido-2-methylpropanesulfonic acid; and having $M_w$ from 12,000 to 25,000;

(b) 15 to 50 wt % carbonate, (c) 0 to 50 wt % citrate and (d) 10 to 40 wt % of a bleaching agent, wherein the composition contains less than 0.1 wt % phosphorus.

2. The composition of claim 1 in which the composition comprises from 20 to 45 wt % carbonate.

3. The composition of claim 2 in which the composition comprises from 20 to 40 wt % citrate.

4. The composition of claim 1, wherein the polymer comprises polymerized units of:

(i) 70 wt % of acrylic acid;

(ii) 20 wt % of maleic acid; and (iii) 10 wt % of 2-acrylamido-2-methylpropanesulfonic acid.

* * * * *